United States Patent [19]

Sloan

[11] Patent Number: 4,789,307

[45] Date of Patent: Dec. 6, 1988

[54] FLOATING PUMP ASSEMBLY

[76] Inventor: Donald L. Sloan, 4008, No. Wheeling Ave., Muncie, Ind. 47304

[21] Appl. No.: 154,223

[22] Filed: Feb. 10, 1988

[51] Int. Cl.[4] ..... F04B 49/04; F04B 21/00

[52] U.S. Cl. ..... 417/40; 417/61; 417/411; 417/423.9; 415/7; 114/183 R

[58] Field of Search ..... 417/40, 61, 411, 423 K; 415/7; 114/183 R

[56] References Cited

U.S. PATENT DOCUMENTS

| | | | |
|---|---|---|---|
| 1,909,578 | 5/1933 | Franke | 417/61 |
| 3,189,334 | 6/1965 | Bell | 417/61 |
| 3,364,862 | 1/1968 | Duveau | 417/40 |
| 3,400,664 | 9/1968 | Kingsep | 415/7 |
| 3,470,822 | 10/1969 | Evans et al. | 417/61 |
| 3,598,501 | 8/1971 | Standfield et al. | 417/61 |
| 3,617,146 | 11/1971 | Garland | 417/61 X |
| 3,726,606 | 4/1973 | Peters | 417/411 X |
| 3,824,852 | 7/1974 | Otto | 417/61 X |
| 3,910,725 | 10/1975 | Rule | 417/411 X |
| 4,256,598 | 5/1981 | Brand | 417/40 |
| 4,275,995 | 6/1981 | Taylor | 417/40 |
| 4,553,902 | 11/1985 | Eberhardt | 417/61 X |

FOREIGN PATENT DOCUMENTS

| | | | |
|---|---|---|---|
| 160188 | 12/1980 | Japan | 417/40 |

*Primary Examiner*—Paul F. Neils

*Attorney, Agent, or Firm*—Woodard, Emhardt, Naughton Moriarty & McNett

[57] ABSTRACT

A pump assembly has a housing with water admitting openings through the housing near the bottom. A pump in the housing has an intake near the bottom. A water level sensor connects the pump to a battery in the housing when the level rises above the pump intake, to operate the pump. Closed cell foam flotation floats the assembly to permit pumping from a pool of any depth greater than one third the height of the housing. Flotation also is arranged to achieve self-righting of the assembly in the event of inadvertent tipping or upset.

13 Claims, 4 Drawing Sheets

FLOATING PUMP ASSEMBLY

DESCRIPTION

1. Technical Field

This invention relates generally to water pumps, and more particularly to a fully self-contained pump assembly for pumping pooled water, and capable of floating in the pool of water.

2. Background Art

There are many instances where small boats (16 feet long or less) moored at docks, are not covered. Consequently, during a rainfall, water accumulates in them. If there is sufficient rain, and the boat is left unattended, the water can accumulate and shift to the point where the boat can become swamped and sink.

There are automatic bailing pumps for boats but, to my knowledge, these built-in as a part of the original equipment in the boat, and are not usually found in inexpensive boats. A portable water bailing device for a boat is disclosed in U.S. Pat. No. 4,050,396, issued Sept. 27, 1977 to Ridgeway. It is connected to a battery which is shown on a bracket in the boat. The pump itself must rest on some surface sufficiently out of the water to avoid damage to the pump motor. The pump is started when water raises enough to lift the float 58 to close the switch 44. Therefore, it cannot be used conveniently if the water in the boat is already too deep when the pump is brought to it to pump it out. Also, if the pump is left in the boat, there will be a problem if the rate of filling of the boat due to rainfall exceeds the pumping rate for a period of time long enough to submerge the pump and damage the motor, even if the heavy rainfall does not last long enough to sink the boat if the pump had continued to operate.

DISCLOSURE OF INVENTION

Described briefly, a typical embodiment of my invention comprises a housing having a bottom and at least one opening through the housing near the bottom so that water can enter the housing. A pump, a battery, and a water sensor switch are in the housing, with the switch being operable to connect the battery to the pump to start the pump when water enters the housing. The pump has an intake near the bottom of the housing, and delivers the water overboard through a tube. Flotation foam is located in the housing and is arranged to cause the pump assembly to float readily, so the battery terminals and electrical contacts are kept out of the water. It is also arranged to cause the assembly to be self-righting in the event that it is inadvertently turned over in the pool in which it is operating.

BEST MODE FOR CARRYING OUT THE INVENTION

Figure 1:
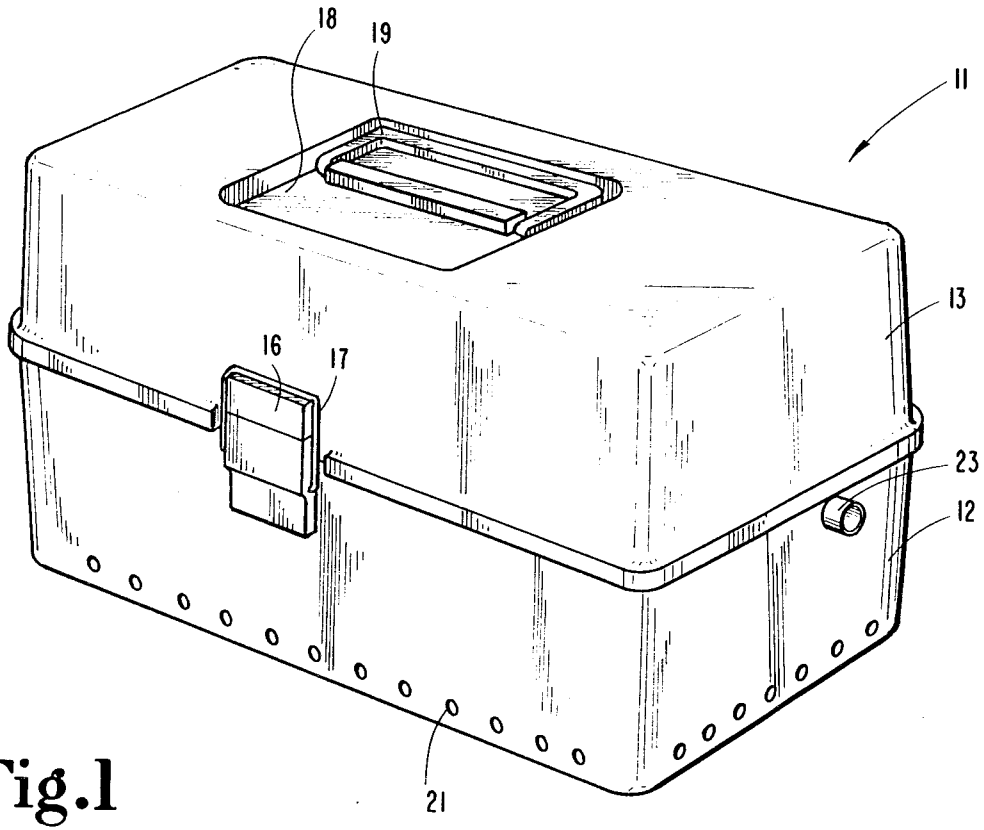
FIG. 1 is a pictorial view of the pump assembly.

Referring now to the drawings in detail, and particularly FIG. 1, the pump assembly 11 includes a convenient portable housing including the bucket 12 with lid 13 hinged to it at 14 with a latch 16 hinged to the bucket and latched to the lid at 17. A recess 18 is provided in the top of the lid, and a folding handle 19 is received in the recess. Thus, the housing is very similar to that of a conventional plastic fishing tackle box, but with two significant exceptions. Holes 21 are provided in the four walls of the bucket at the bottom 22 of the bucket to admit water to the interior. An additional hole is provided in the end wall immediately below the lid 13 and receives through it a hose connecting adaptor 23.

A pump 24, battery 26 and water level sensor switch assembly 27 are mounted in the bucket. Each of these devices has feet such as bosses 28 on pump 24, ribs 29 on the bottom of the case of battery 26, and bosses 31 on the bottom of the switch assembly 27, all resting on the bottom of the bucket but spacing the respective devices slightly above the bottom. This enables water to move freely under these respective devices from end-to-end and side-to-side of the bucket. Similarly, although the bucket is essentially filled with a closed-cell plastic foam flotation material at 32 surrounding the pump, battery and switch assembly 27, the foam does not extend completely to the bottom but stops at the lower edge 32L above the holes 21. This enables water to flow freely across the bucket bottom and enter the bottom intake opening 24I of the pump 24 and 27I of the switch assembly 27 from any of the four sides of the bucket. Thus, when the sensor assembly senses water above a level L-1 in the bucket, it turns on the pump 24.

The water sensor switch assembly 27 has one wire 33 connected to the positive terminal 34 of the battery. The other wire 36 from the switch assembly is connected to the pump 24. The return wire 37 from the pump is connected to the negative terminal 38 of the battery. Consequently, when the switch 27 is closed, the electrical circuit is completed through the battery and pump 24, operating the pump.

Figure 3:
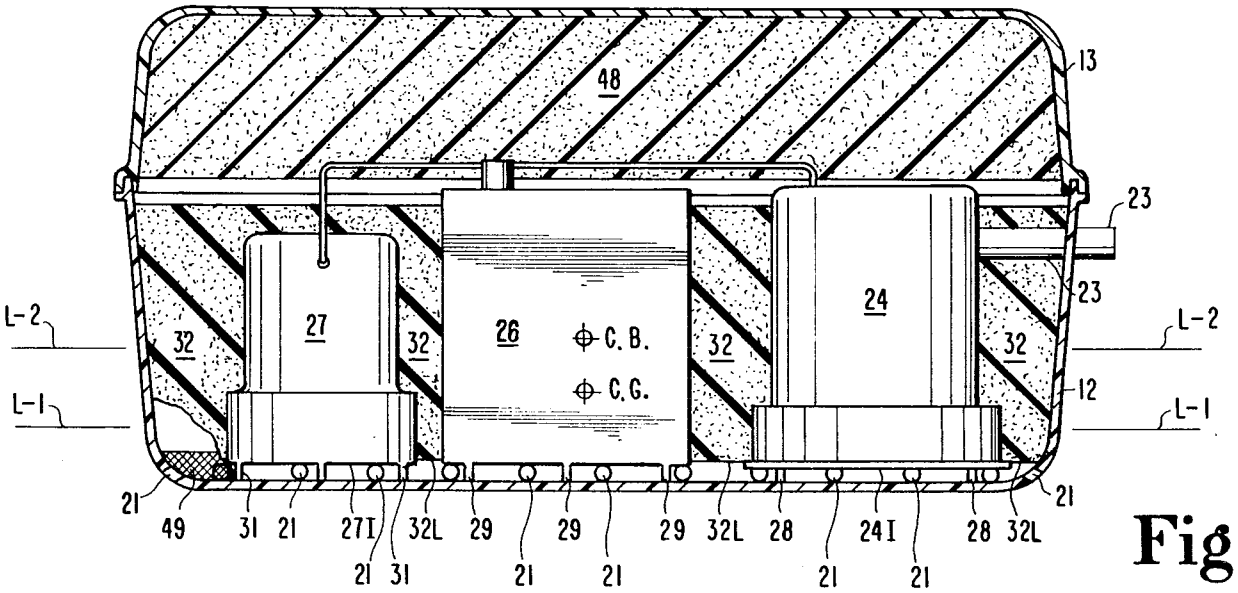
FIG. 3 is a longitudinal sectional view of the pump assembly taken at line 3—3 in FIG. 2 and viewed in the direction of the arrows.
Figure 4:
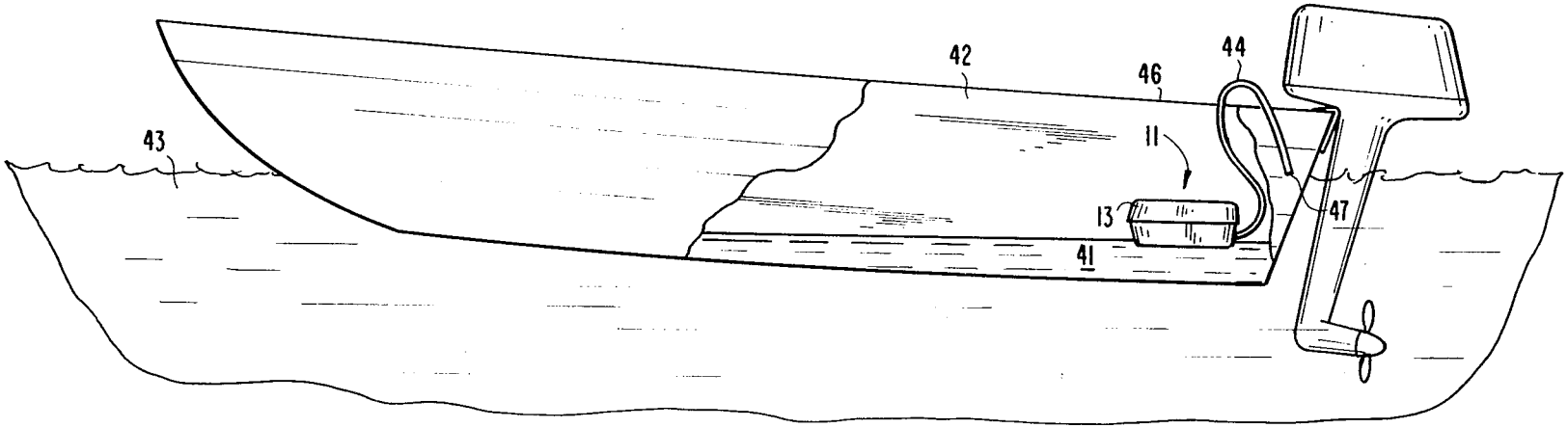
FIG. 4 is a side view of the pump assembly mounted in a boat.

The volume of foam 32 which is anchored in the bucket 12 is such that the displacement of the foam and device portions within the foam is such that the pump assembly 11 will float one-third submerged as shown in FIG. 4. Thus, the volume of foam and components in the bucket below the level L-2 in the bucket displaces water in an amount equal to the weight of the entire pump assembly. Level L-2 is well below the top of the battery and the electrical leads from the pump and water level sensor switch to the battery and to each other. Although it is easy to have a pump 24 which can operate fully submerged, and a sensor switch assembly 27 which can operated largely submerged, the significant flotation volume eliminates any likelihood of moisture intrusion in a way to interfere with any of these devices. This is true even if there is a certain amount of movement of water 41 in the bilge of the boat 42 as the boat rocks in the lake 43. Also, since the center of buoyancy (C.B. in FIG. 3) is above the center of gravity (C.G. in FIG. 3), the pump assembly will right itself even it has become tipped over inadvertently. A pump discharge hose 44 is connected to the adaptor tube 23 from the pump and is thrown over the gunwale 46 of the boat to discharge at 47 into the lake.

As examples, but without limitation, the dimensions of the housing may be 13 inches long, 6.5 inches high and 7 inches wide. The entire pump assembly according to this invention, weighs about $4\frac{3}{4}$ pounds, including the battery. A standard 12 volt motorcycle or recreational vehicle battery may be used. A standard fully-automated float switch can be used for the water sensor assembly 27. A standard submersible bilge pump can be used at 24. With this combination, the pump can operate for approximately three hours and twenty minutes, pumping a total of 1,200 gallons water, before the battery needs to be recharged. If left in an unattended boat to pump rainwater, the pump could cycle 20 times at 10 minutes per cycle, pumping approximately 60 gallons per cycle, before battery recharging would be needed.

The lid 13 is typically packed with additional closed cell foam 48 so that, when the lid is closed, the foam in the lid further assists in holding the pump, battery and switch assembly in place. It is preferable that these devices be independently held in place in the bucket by bolting to the bucket but, it is not necessary since the foam packing 48 in the lid will hold them in place, even if the entire pump assembly is turned upside down. It is preferable that the foam packing 32 in the bucket not be fastened to the bucket or to the devices. Then, if it is necessary to remove or replace any of these devices, it can be conveniently done by simply disconnecting the wires, lifting out the packing 32, and then unfastening the device from the bucket.

Figure 2:
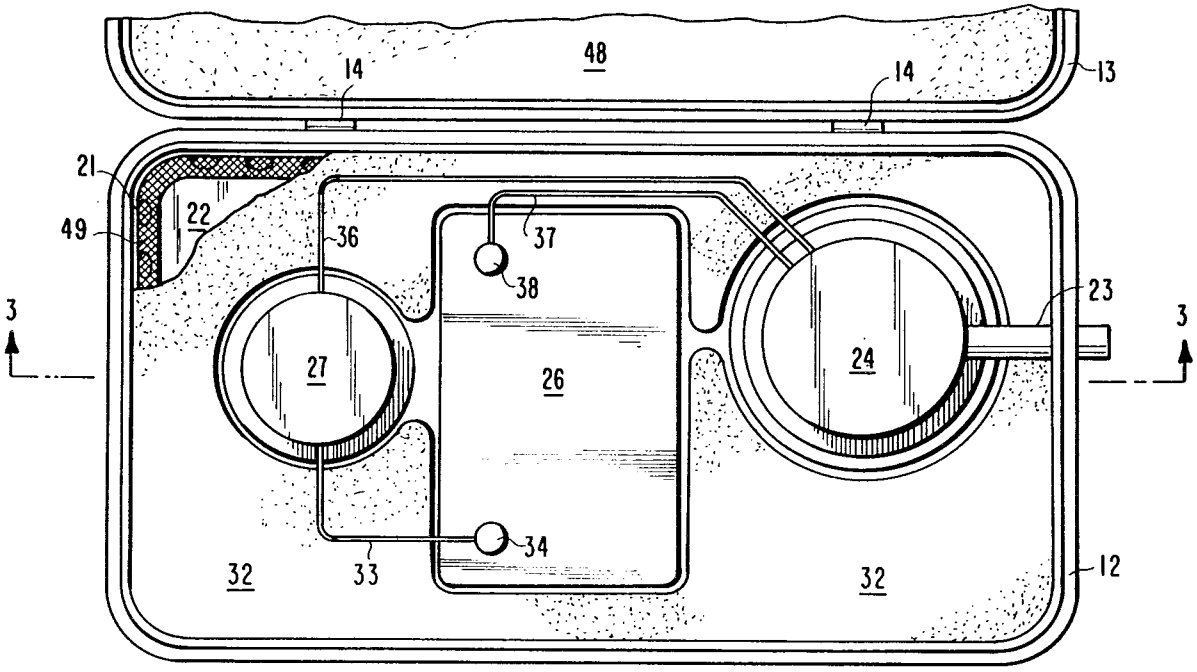
FIG. 2 is a top plan view of the pump assembly.

In order to exclude dirt and other debris from the interior of the bucket, a plastic mesh 49 is secured in the bucket around the entire inner perimeter of the bottom and covering the holes 21. A portion of the foam 32 is broken out in FIGS. 2 and 3 to show this, but the illustration of the mesh is stopped to the bottom left of the switch assembly 27 in order to clearly show the holes 21 on the far wall of the bucket.

The hose to be used is preferably a clear plastic which can be very light in weight and flexible, preferably ¾ inch in diameter. Such hose is readily available in coils or cut to length. Attachments can be connected to the discharge end of the hose so the pump assembly can be adapted to uses other than pumping water from boats. For example, a shower head can be attached to the hose, and the pump placed in a tub or pool of water to create a shower facility in back country camping. It could also be used in a hot tub.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A pump assembly comprising:

a housing having a bottom and at least one opening through the housing near the bottom;

an electrical energy source in said housing;

a pump in said housing and having an intake near the bottom of the housing;

sensor means in said housing and coupled to said energy source and to said pump to energize and cause said pump to operate in response to detection of water in said housing at a level above said pump intake;

flotation means in said housing and arranged to float the pump assembly when the water rises to a level in said housing above the pump intake;

whereby said pump assembly is floatable in a pool and can pump from the pool while floating in it.

2. The pump assembly of claim 1 wherein:

said energy source is a battery.

3. The pump assembly of claim 2 wherein:

said battery is at a level in said housing higher than said pump intake.

4. A pump assembly comprising:

a housing having a bottom and at least one opening through the housing near the bottom;

an electrical energy source in said housing;

a pump in said housing and having an intake near the bottom of the housing;

water level response means in said housing and coupled to said energy source and to said pump to energize and cause said pump to operate in response to detection of water above a first predetermined level in said housing, relative to the bottom of said housing, said pump intake being located below said level;

flotation means in said housing and arranged to displace a volume of water weighing an amount equal to the weight of the pump assembly when the water rises to a second predetermined level in said housing relative to the bottom of said housing, said second level being above said first level;

whereby said pump assembly is floatable in a pool and can pump from the pool while floating in it.

5. The pump assembly of claim 4 wherein:

said pump is electrically driven; and said energy source is a battery.

6. The pump assembly of claim 4 wherein:

the water level response means is an automatic float switch.

7. The pump assembly of claim 4 wherein:

the center of buoyancy of said flotation means relative to said housing bottom is above the center of gravity of said pump assembly, whereby said pump assembly is self-righting when floating in a pool.

8. The pump assembly of claim 4 wherein:

the flotation means is such that said pump assembly, when floating in a pool, floats with one-third of said housing below the surface of the pool.

9. The pump assembly of claim 4 and wherein said housing incudes a bucket and a lid attached to the bucket and normally closed on the bucket, the assembly further comprising:

closed cell plastic foam flotation material substantially filling the lid.

10. The pump assembly of claim 1 and wherein:

the said second level is about one third of the height of the housing above the bottom of the housing.

11. The pump assembly of claim 4 wherein:

said opening includes a plurality of holes in the housing around the perimeter of the bottom of the housing, the assembly further comprising:

filter means covering said holes to preclude dirt from entering said housing through said opening, but admit water into said housing.

12. The pump assembly of claim 4 wherein:

said housing is in the form of a rectangular closed box having dimensions less than 15 inches long, less than 7 inches high and less than 8 inches wide.

13. The pump assembly of claim 4 wherein:

the weight of said pump assembly is less then five pounds.

* * * * *